US011709028B1

(12) United States Patent
Vernon

(10) Patent No.: US 11,709,028 B1
(45) Date of Patent: Jul. 25, 2023

(54) SAFETY SELECTOR ASSEMBLY FOR A FIREARM

(71) Applicant: Vigilant Gear, LLC, Priest River, ID (US)

(72) Inventor: Matthew A. Vernon, Hayden, ID (US)

(73) Assignee: Vigilant Gear, LLC, Priest River, ID (US)

( * ) Notice: Subject to any disclaimer, the term of this patent is extended or adjusted under 35 U.S.C. 154(b) by 0 days.

(21) Appl. No.: 17/511,640

(22) Filed: Oct. 27, 2021

Related U.S. Application Data

(60) Provisional application No. 63/106,746, filed on Oct. 28, 2020.

(51) Int. Cl.
*F41A 17/64* (2006.01)
*F41A 17/70* (2006.01)
*F41A 17/42* (2006.01)

(52) U.S. Cl.
CPC ..... *F41A 17/64* (2013.01); *F41A 17/42* (2013.01); *F41A 17/70* (2013.01)

(58) Field of Classification Search
CPC ..... F41A 17/24; F41A 17/52; F41A 17/62; F41A 17/64; F41A 17/70; F41A 17/80; F41A 17/00
See application file for complete search history.

(56) References Cited

U.S. PATENT DOCUMENTS 1,461,387 A * 7/1923 Fearn ..... F41A 17/64 89/148
2,781,697 A * 2/1957 Kimball ..... F41A 19/44 42/69.01
4,658,529 A * 4/1987 Bertolini ..... F41A 17/64 42/70.08
5,036,612 A * 8/1991 Jennings ..... F41A 17/24 42/70.08
6,560,909 B2 5/2003 Cominolli
6,601,331 B2 8/2003 Salvitti
7,690,144 B2 4/2010 Fagundes de Campos
7,827,720 B1 * 11/2010 Erdem ..... F41A 17/42 42/70.08
8,046,948 B2 11/2011 Mauch
8,959,819 B2 2/2015 Jones
9,970,726 B1 5/2018 Hubert
10,612,870 B2 4/2020 Borges
10,739,090 B2 8/2020 Borges
(Continued)

FOREIGN PATENT DOCUMENTS

CA 2444058 10/2004
EP 1443295 8/2004
WO WO-2016085415 A1 * 6/2016

OTHER PUBLICATIONS

U.S. Appl. No. 63/106,746, filed Oct. 28, 2020 titled Safety Selector Assembly for a Firearm.
(Continued)

*Primary Examiner* — Gabriel J. Klein
(74) *Attorney, Agent, or Firm* — Dinsmore & Shohl LLP

(57) ABSTRACT

Present embodiments relate to a safety selector assembly for a firearm. More specifically, present embodiments relate to, without limitation, a safety selector assembly for a firearm which may be added to a slide post-manufacturing, or which may be manufactured and assembled with the slide.

10 Claims, 10 Drawing Sheets

(56) References Cited

U.S. PATENT DOCUMENTS

| | | | | |
|---|---|---|---|---|
| 2002/0162264 | A1* | 11/2002 | Shimi | F41A 17/64 42/70.08 |
| 2003/0213159 | A1 | 11/2003 | Cutini | |
| 2013/0000173 | A1* | 1/2013 | Green | F41A 17/72 42/70.11 |
| 2015/0184966 | A1* | 7/2015 | Beck | F41A 17/64 42/70.08 |
| 2017/0350665 | A1 | 12/2017 | Borges | |
| 2018/0328681 | A1 | 11/2018 | Borges | |
| 2019/0024996 | A1 | 1/2019 | Borges | |
| 2020/0217604 | A1 | 7/2020 | Borges | |
| 2020/0292255 | A1 | 9/2020 | Borges | |
| 2021/0080211 | A1* | 3/2021 | Barrett | F41A 17/62 |

OTHER PUBLICATIONS

U.S. Appl. No. 63/106,761, filed Oct. 28, 2020 titled Firearm and Method of Teaching Use.
U.S. Appl. No. 63/117,816, filed Nov. 24, 2020 titled Unfinished Firearm.
U.S. Appl. No. 17/533,690, filed Nov. 23, 2021 titled Unfinished Firearm.

* cited by examiner

SAFETY SELECTOR ASSEMBLY FOR A FIREARM

CLAIM TO PRIORITY

This non-provisional patent application claims priority to and benefit of, under 35 U.S.C. § 119(e), U.S. Provisional Patent Application Ser. No. 63/106,746, filed Oct. 28, 2020 and titled "Safety Selector Assembly for a Firearm", all of which is incorporated by reference herein.

BACKGROUND

1. Field of the Invention

Present embodiments relate to a safety selector assembly for a firearm. More specifically, present embodiments relate to, without limitation, a safety selector assembly for a firearm which may be added to a slide post-manufacturing, or which may be manufactured and assembled with the slide.

2. Description of the Related Art

When users who are new to firearms purchase a gun, they are often apprehensive about firearms which do not have a safety switch. While some firearms have a safety feature which may be built into the trigger, the trigger pull, or otherwise on the frame the lack of a positively moving safety switch may make new users nervous about carrying the weapon or having the weapon in a home or in a car. However, numerous striker fire type guns do not have such safety switch but instead build in a safety feature in other ways. This can lead to some apprehension for users of the firearm, especially those new to firearms.

It would be desirable to allow users to purchase a weapon of their liking, while addressing this issue of providing a positively movable safety switch and alleviating concern of these users.

The information included in this Background section of the specification, including any references cited herein and any description or discussion thereof, is included for technical reference purposes only and is not to be regarded subject matter by which the scope of the invention is to be bound.

SUMMARY

The present application discloses one or more of the features recited in the appended claims and/or the following features which alone or in any combination, may comprise patentable subject matter.

The present embodiments provide a safety selector assembly for a firearm. The safety selector assembly provides a safety selector switch which is capable of being located on the slide of the firearm, either at time of manufacture, or as an aftermarket product which is capable of being added on to a previously manufactured slide. The positioning of the safety selector switch on the slide provides an easily locatable feature for a user to determine if the gun is capable of firing or not. The safety selector assembly provides confidence to a user who may be apprehensive about the firing condition of a striker fire gun.

According to some embodiments, a safety selector assembly may comprise a safety housing, a safety selector switch having an actuator and a stem, the safety selector switch being movable relative to the safety housing, a safety selector shaft having a cam surface, the stem engaging the cam surface wherein movement of the stem causes movement of the safety selector shaft, and, an interference piston which moves between a first position and a second interference position based on movement of the safety selector switch and the safety selector shaft.

According to some optional embodiments, the following features may be used alone with the safety selector assembly or together with other optional features and the safety selector assembly. The safety selector assembly may be configured to connect to a firearm slide. The safety selector switch may by moveable in one of a longitudinal, a lateral, or a vertical direction of the firearm slide. The interference piston may have the first position wherein a safety plunger can move. The interference piston may have a second position wherein a safety plunger cannot move due to interference with the interference piston. The safety housing may have a fastener aperture which allows for connection to a firearm slide. The safety housing may further comprise a spring seat. The safety housing may comprise a bore may have the safety selector shaft therein. The safety housing may comprise a channel in open communication with the bore. The safety selector shaft may have a cam surface, the interference piston engaging the cam surface wherein movement of the safety selector shaft causes movement of the interference piston between the first position and the second interference position.

According to another embodiment, a firearm slide may comprise a top wall, a first side wall, and a second side wall, the first side wall and the second side wall depending from the top wall, a safety selector assembly having a safety selector switch, the safety selector switch disposed on an outer surface of one of the first side wall or the second side wall.

According to some optional embodiments, the following features may be used alone with the firearm slide or together with other optional features and the firearm slide. The firearm slide may further comprise a safety housing disposed in an opening of the firearm slide. The safety selector switch may have an actuator and a finger, the safety selector switch may be movable relative to the safety housing. The safety selector shaft may have a cam surface, the finger engaging the cam surface wherein movement of the finger causes movement of the safety selector shaft. An interference piston which moves between a first position and a second interference position based on movement of the safety selector switch and the safety selector shaft. The firearm slide may further comprise a spring seat on one of the safety housing or an undersurface of the top wall.

According to some embodiments, a method of providing a safety assembly for a firearm may comprise providing a housing which is capable of being positioned on a slide of a firearm, providing a safety selector switch on the housing of the slide, operably connecting the safety selector switch to an interference piston, moving the safety selector switch to a fire ready position and inhibiting interference between the interference piston and a safety plunger and, moving the safety selector switch to a safety position wherein the interference piston interferes with movement of the safety plunger and inhibits firing of the firearm.

According to some optional steps, the method may further comprise manufacturing the slide to receive the housing. The method may further comprise machining the slide to receive the housing.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of a safety selector assembly for a firearm will now be described by way of examples. These embodiments are not to limit the scope of the claims as other embodiments of an orthopedic brace will become apparent to one having ordinary skill in the art upon reading the instant description. Non-limiting examples of the present embodiments are shown in figures wherein:

DETAILED DESCRIPTION

Figure 1:
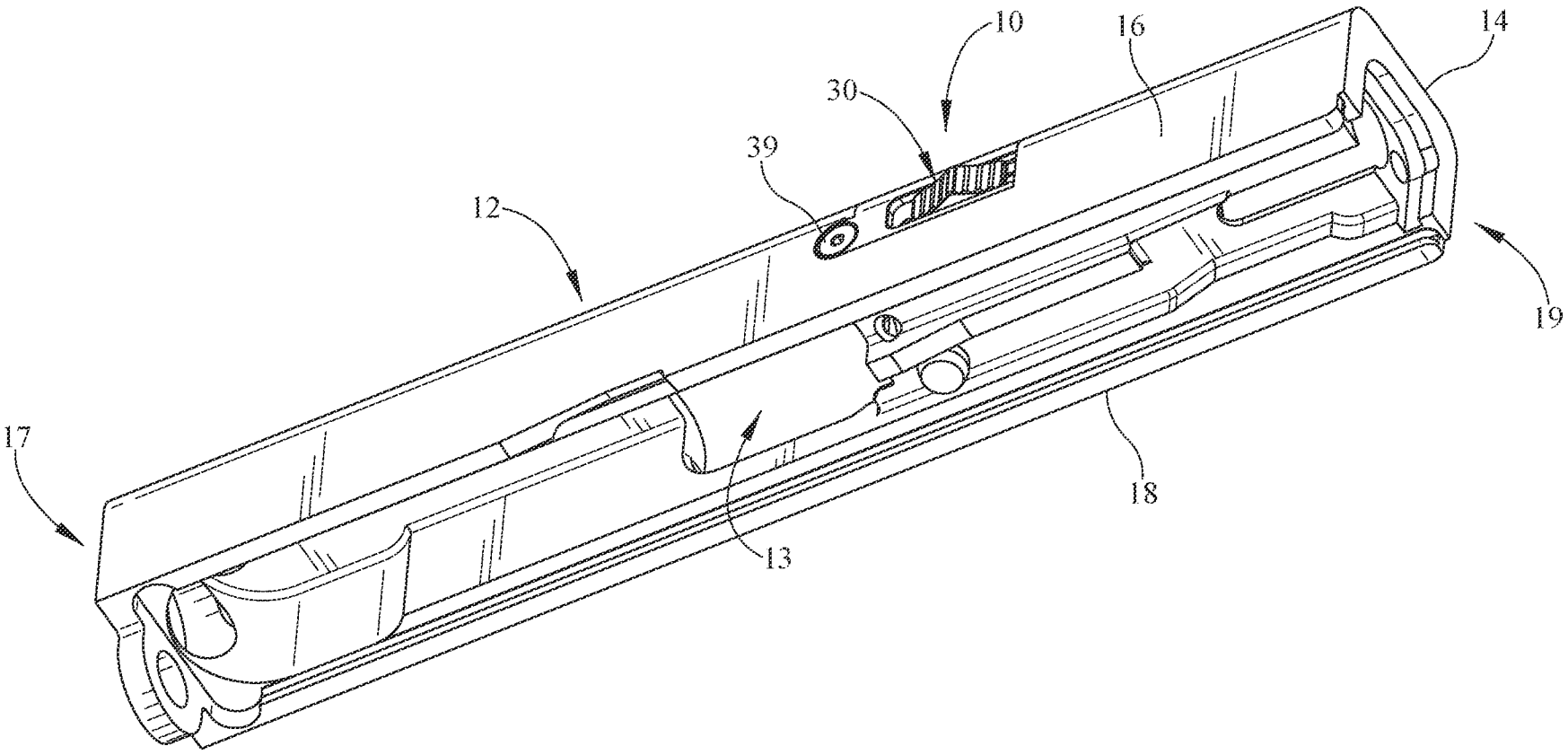
FIG. 1 is a perspective view of a firearm slide having a safety selector assembly.

It is to be understood that a safety selector assembly for a firearm is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Referring now to FIGS. 1-10 relate to a safety selector assembly, which may be manufactured with a slide or may be added to a modified slide in order to provide a positively movable safety switch for a firearm. The safety selector assembly is provided on the slide of the firearm which makes the switch readily presented to a user who prefers easy access to such switch and who may be slightly nervous about use and/or carry of the firearm.

Referring now to FIG. 1, a perspective view of a non-limiting example of a safety selector assembly 10 is provided. The safety selector assembly 10 is positioned on a firearm slide 12. The slide 12 may be manufactured and sold with the safety selector assembly 10 provided therein, or the slide 12 may be previously manufactured, wherein the user chooses to add the safety selector assembly to the pre-existing slide. Some manufacturers of slides may include, but are not limited to, SIG SAUER, GLOCK, SMITH & WESSON, among numerous others. Present embodiments may be used with, for non-limiting example, striker-fired guns with any of the above manufacturers or others, with modification of dimensions or par shapes in order to function with those slides. In the depicted embodiment, the frame, grip, and other components are removed for clarity.

The safety selector assembly 10 may comprise a safety selector switch 30 which is movable between at least two positions. In one position, the safety selector switch 30 may be in a fire ready position, meaning the firearm may be fired. In a second position, the safety selector switch 30 may be in a safe, or no-fire, position. In such position for example, the trigger may be inhibited from a complete firing motion, or alternatively, one or more parts necessary for actuation may be inhibited from movement to cause the firearm to fire. In the depicted embodiment, the safety selector switch 30 moves parallel to the longitudinal direction of the slide 12. However in some embodiments, the switch 30 may move laterally, across the top surface of the slide 12, or vertically relative to the slide 12. Various movements may be utilized to change between a safe position and a fire-ready position.

Adjacent to the safety selector switch 30 may be a fastener 39 which may be used to connect the safety selector assembly 10 to the slide 12. Various fastener types may be utilized. Further, additional and/or alternative means of connection may also be utilized, for example the safety selector assembly 10 may also have an interference fit with an opening 15 (FIG. 2) in the slide 12.

The slide 12 has a top wall 14, a first side wall 16 and a second side wall 18. The first and second side walls 16, 18 depend from the top wall 14 and are generally perpendicular to the top wall 14. The slide 12 is provided with an opening 15 (FIG. 2) for the safety selector assembly 10 and an ejection opening 13 for the ejection of spent cartridges. The opening 15 (FIG. 2) for the safety selector assembly 10 extends along one of the side walls 16, 18 and the top wall 14.

The slide 12 also comprises a forward end 17 wherein the barrel is co-aligned with the forward end 17 for firing of a projectile (not shown), and a rearward end 19.

The safety selector assembly 10 comprises a housing 20 (FIG. 2) which extends from one of the side walls 16, 18 to the top wall 14. The housing 20 is sized to fit within the opening 15 of the slide 12 which corresponds to the safety selector assembly 10.

Disposed on the side of the housing 20 is a safety selector switch 30. The safety selector switch 30 is movable between first and second positions in order change between safety and fire functions. The safety selector switch 30 moves along the outer surface of the housing 20.

Figure 2:
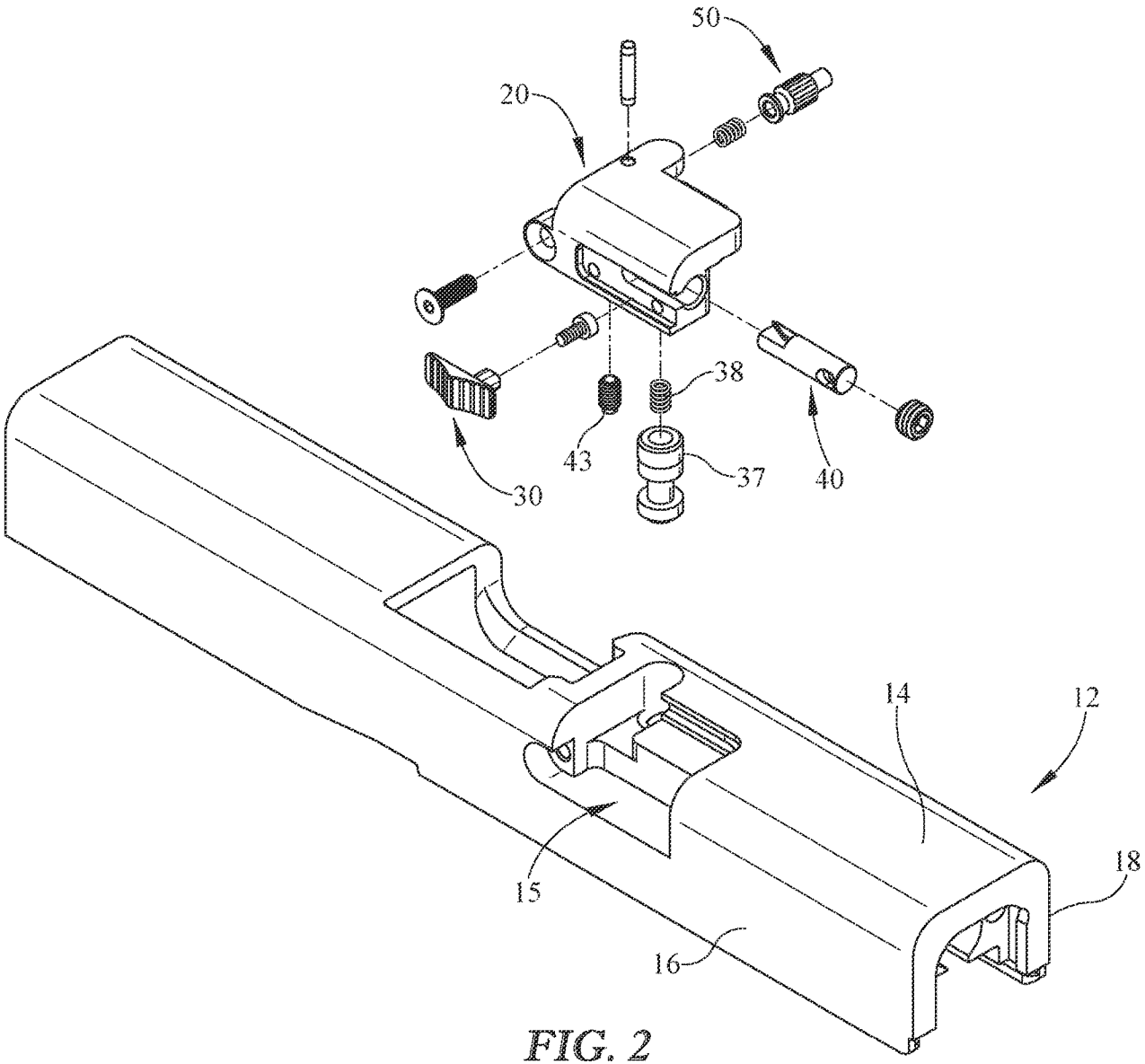
FIG. 2 is an exploded perspective view of the slide and the safety selector assembly.

Referring now to FIG. 2, an exploded perspective view of the safety selector assembly 10 and slide 12 is shown. In this view the safety selector assembly 10 is shown removed from the slide 12 and additionally, the various components of the assembly 10 are shown. The components, or parts, will be named in this description and then subsequently referred to in individual figures. The slide 12 comprises the assembly opening 15. The opening 15 is similarly sized and shaped to receive the housing 20 of the assembly 10. The housing 20 shape and the opening 15 shape may vary in order to be utilized with various manufacturers' types of firearms.

Exploded from the housing 20 is a safety selector switch 30 which moves relative to the housing 20. Moveable within the housing 20 is a safety selector shaft 40 which moves with the safety selector switch 30 within the housing 20. Thus, when a user moves the safety selector switch 30 to select a safe position or a fire position, the safety selector shaft 40 moves with the switch 30.

Also moveable within the housing 20 is an interference piston 50. The interference piston 50 moves between first and second positions to either allow or inhibit firing of the weapon. The interference piston 50 may be oriented at an angle to the safety selector shaft 40 and in the instant embodiment is substantially perpendicular to the safety selector shaft 40. In one of the two positions, the interference piston 50 blocks movement of a safety plunger, and in another retracted position, the interference piston 50 does not block the safety plunger 37.

Also shown in FIG. 2 is a set screw or fastener with ball detent 43 which retains and guides the safety selector shaft 40. With brief reference to FIG. 10, the ball detent 43 is engaged by a detent cavity in the shaft 40 and aids to capture the shaft 40 while still allowing sliding motion within the housing 20.

Figure 3:
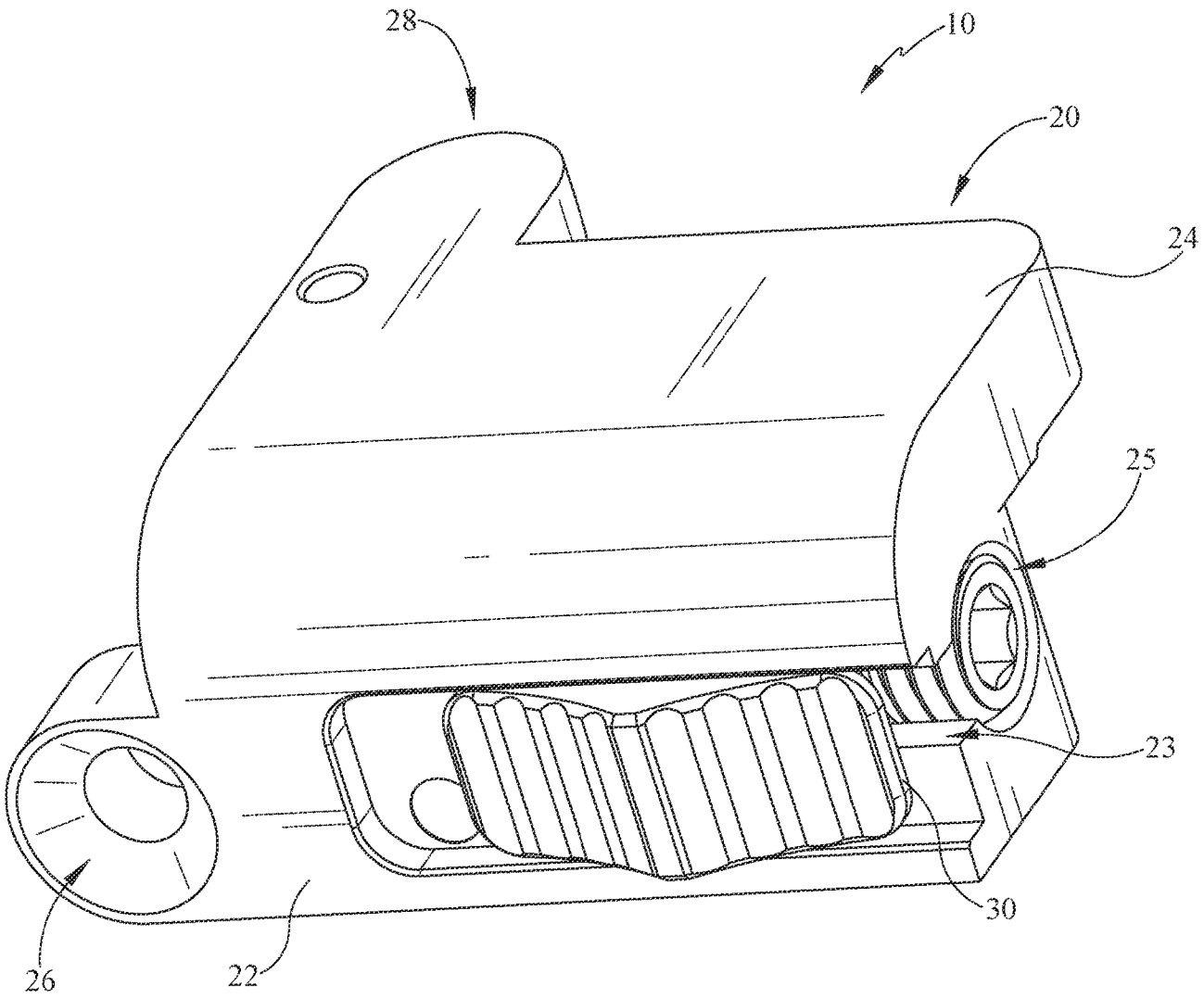
FIG. 3 is a perspective view of the safety selector assembly removed from the slide.

With reference now to FIG. 3, the safety selector assembly 10 is shown removed from the slide 12 (FIG. 1). The safety selector switch 30 is shown and moves relative to the housing 20. The housing 20 has a first wall portion 22, which corresponds to one of the side walls 16, 18 of the slide 12, and a second wall portion 24 which corresponds to the top wall 14. The housing 20 further comprises a fastener aperture 26 which aligns with an aperture in the slide 12 (FIG. 2) and allows fastening of the housing 20 to the slide 12. The fastener aperture 26 may be on one wall portion 22 and a second locating tab 28 may be located on a second wall portion 24 so that the housing 20 may be applied easily and the user will understand how to orient and locate the housing 20 relative to the corresponding opening 15 of the slide 12.

The safety selector switch 30 is shown disposed adjacent to a channel 23 which is in communication with a bore 25. The safety selector switch 30 moves and a stem 34 (FIG. 5) extends into the bore 25 to engage the safety selector shaft 40, causing movement of the shaft 40. The housing 20 may also comprise a recess wherein the switch 30 is located and aids to guide the switch 30 movement, while reducing the amount that the switch 30 extends from the slide 12.

Further, the assembly 10 may be utilized as an aftermarket addition to a firearm or may be manufactured and installed as an OEM feature. For example, a user with an existing firearm, may remove the slide and send the slide to a gunsmith for installation of the assembly 10. Alternately, it may be that the assembly is manufactured with the firearm and the firearm is sold with the assembly 10 already installed.

Figure 4:
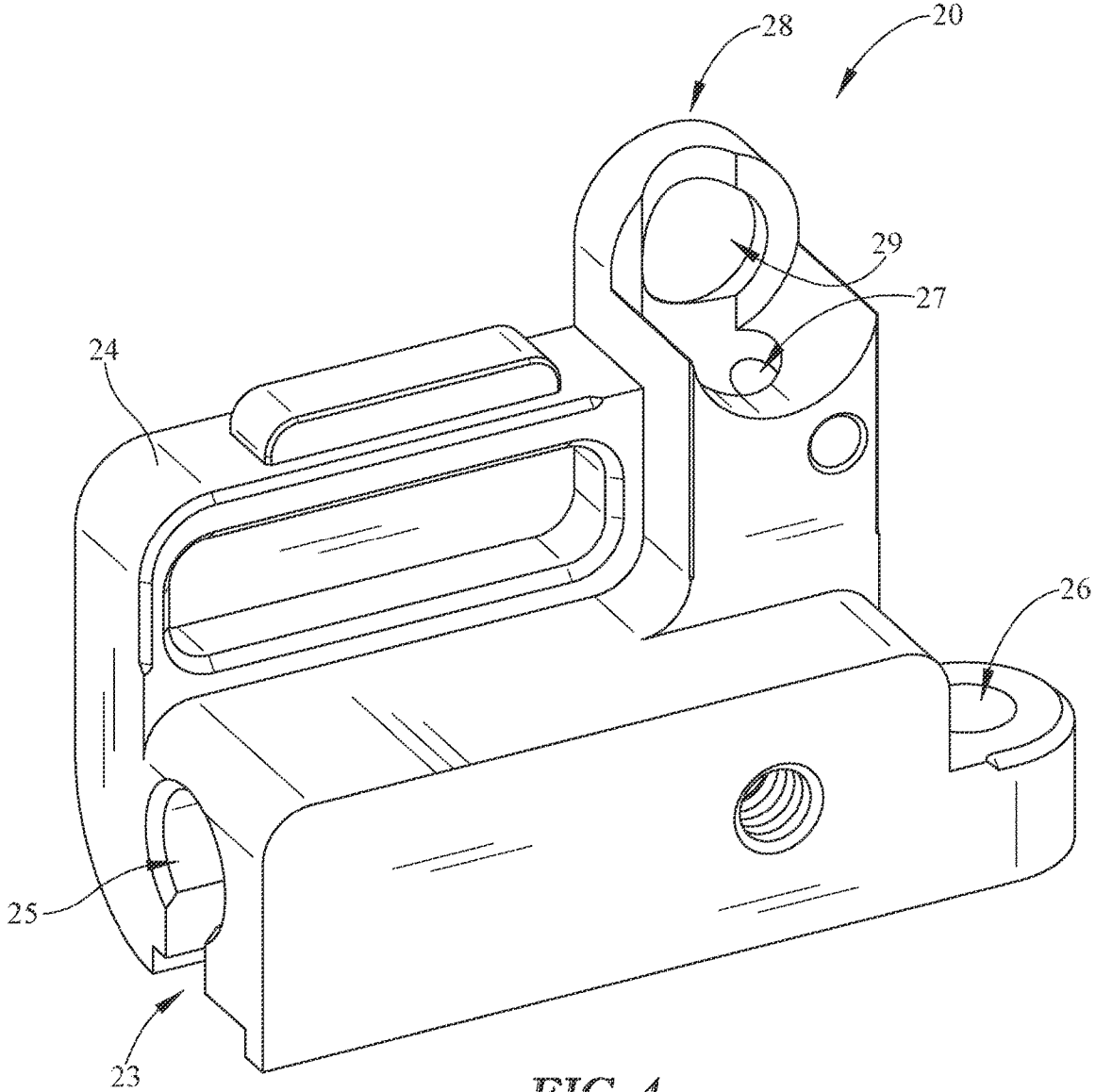
FIG. 4 is a perspective view of the safety housing.

With reference now to FIG. 4, the housing 20 is shown from below. On the undersurface of the tab 28 is a spring seat 29. A safety plunger (not shown) below the spring seat 29 may be engaged by a spring 38 (FIG. 2) to bias the safety plunger 37 (FIG. 2) in one direction, away from the spring seat 29.

Beneath the tab 28 is a piston bore 27. The interference piston 50 (FIG. 2) is positioned in the piston bore 27 and is moveable between extended and retracted positions, in order to block or not block the safety plunger 37 from moving.

Further, the housing 20 may comprise one or more weep holes for cleaning. For example solvent may be disposed in the weep holes to clean the interior of the housing 20. Additionally, or alternatively, the weep holes may be used with compressed air to aid in cleaning the interior passageways of the housing 20.

Figure 5:
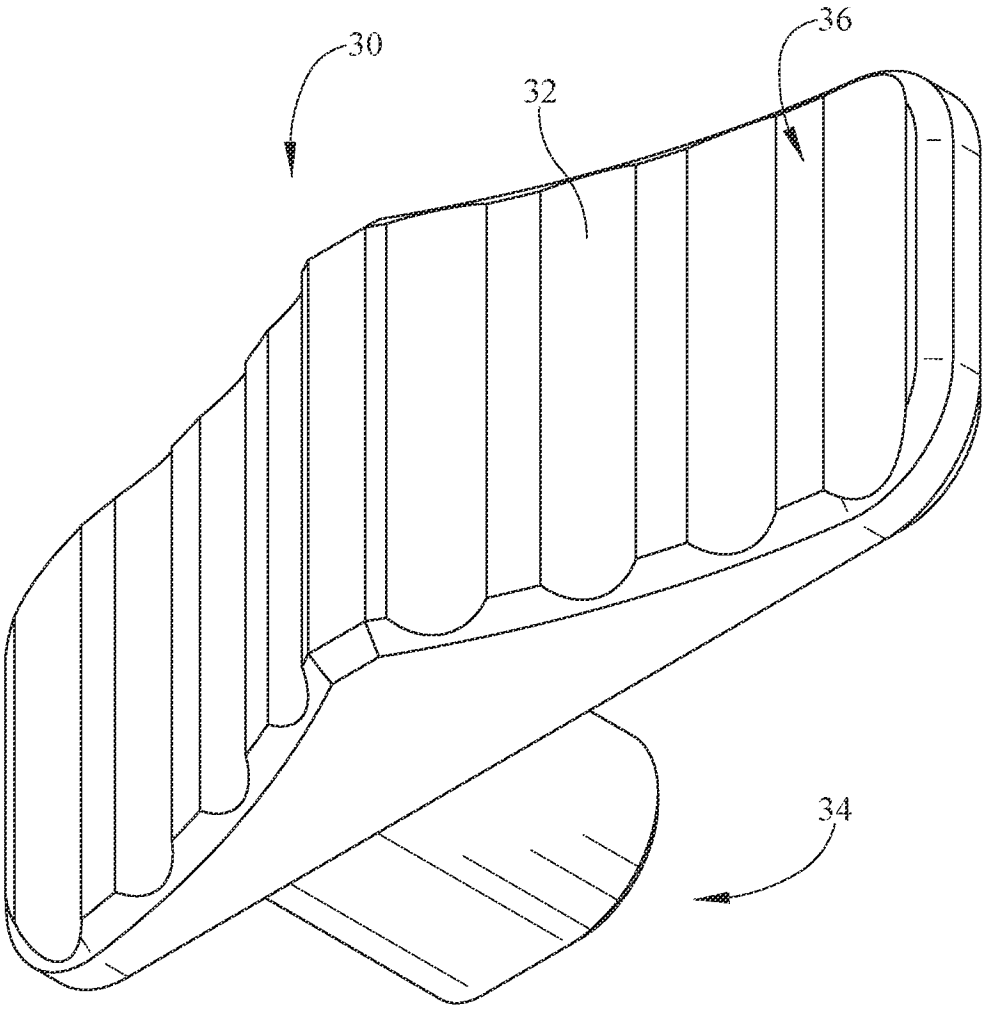
FIG. 5 is a perspective view of the safety selector switch

With reference now to FIG. 5, the safety selector switch 30 is shown in perspective view. The safety selector switch 30 moves along the outer surface of the housing 20, which is positioned adjacent to the slide 12 and, in some embodiments within a recess of the housing 20. The switch 30 provides a positively moveable structure to allow the user to place the gun in a safe, no-fire condition, or a fire ready position. The safety selector switch 30 includes an actuator 32 and a stem 34. The actuator 32 may have a grip enhancing feature 36, such as grooves, knurling, or other features to aid engagement of the switch 30 by the user. The actuator 32 may have a flat shape, may have ramps that form a peak as shown, or may be curved, to promote engagement with a user's finger and provide a feature against which the user's finger may move the safety selector switch 30. The stem 34 extends through the channel 23 (FIG. 3) of the housing 20 (FIG. 3) so that when the actuator 32 moves, the stem 34 causes movement of the safety selector shaft 40 within the bore 25 (FIG. 3) of housing 20.

Figure 6:
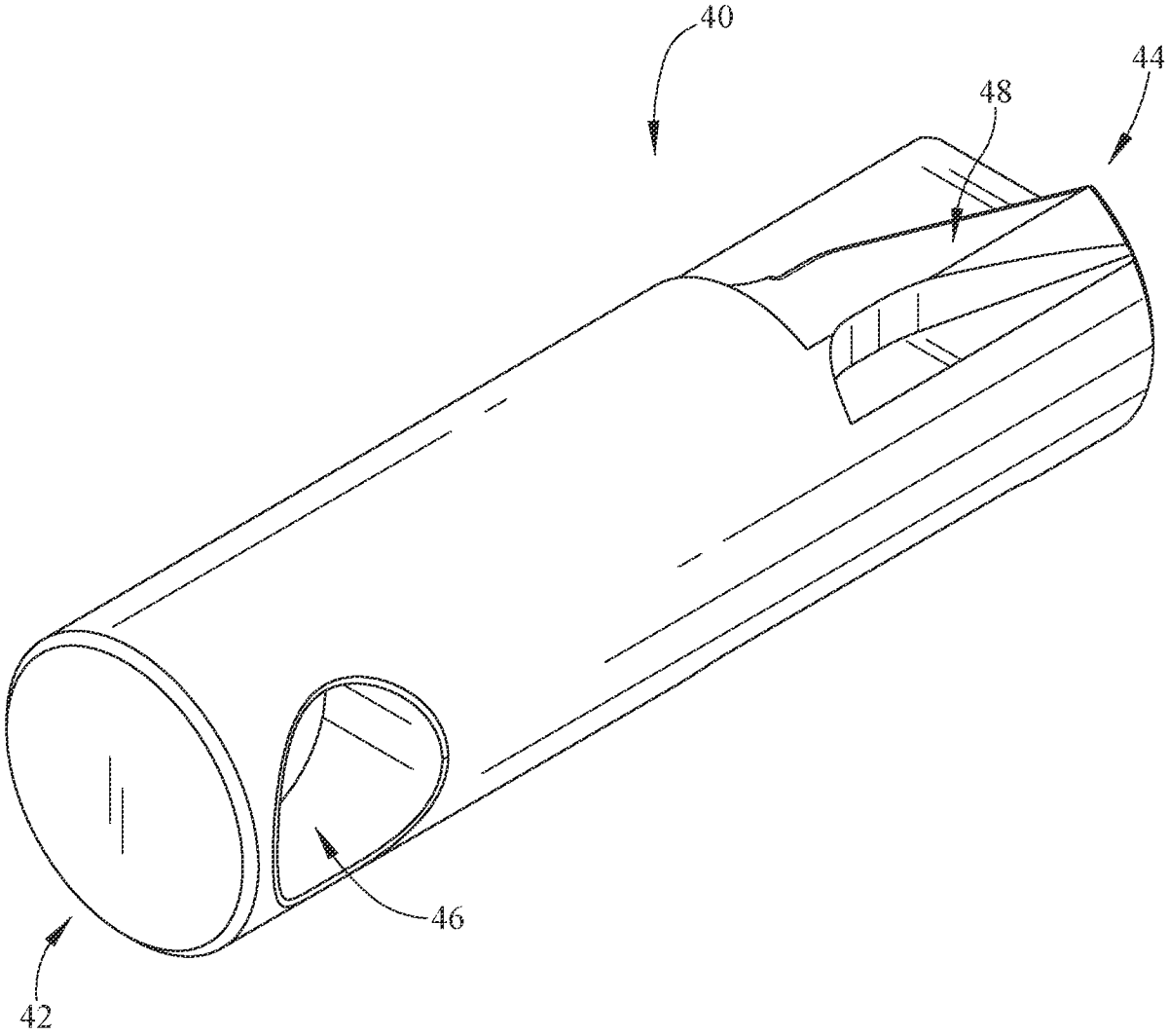
FIG. 6 is a perspective view of the safety selector shaft.

Referring now to FIG. 6, the safety selector shaft 40 is shown in perspective view. The safety selector shaft 40 is sized to fit within the bore 25 (FIG. 3) of the housing 20 (FIG. 3) and move coaxially therein. The safety selector shaft 40 is shown having a circular cross-section but may have various cross-sectional shapes, which may slide relative to a bore 25 shape in the housing 20. The safety selector shaft 40 has a longitudinal axis which extends between first and second ends 42, 44. The safety selector shaft 40 further comprises a stem receiver 46. The stem receiver 46 is sized to receive the stem 34 (FIG. 5). The stem receiver 46 may be formed of various shapes which correspond to the stem 34 shape and for example may have a friction fit, may be adhered, or otherwise connected or joined together.

Toward the second end 44 of the shaft 40, the shaft 40 has a cut or relief area formed and a cam or finger 48 formed in the relief area. The cam 48 moves relative to the housing bore 25 with movement of the safety selector switch 30. The cam 48 engages the interference piston 50 which causes movement of the piston 50 when the safety selector shaft 40 moves. Stated alternatively, the interference piston 50 acts as a follower, following movement of the safety selector shaft 40. The cam 48 and/or the interference piston 50 may be varied in shape to vary the movement of the interference piston 50 when the shaft 40 moves.

Figure 7:
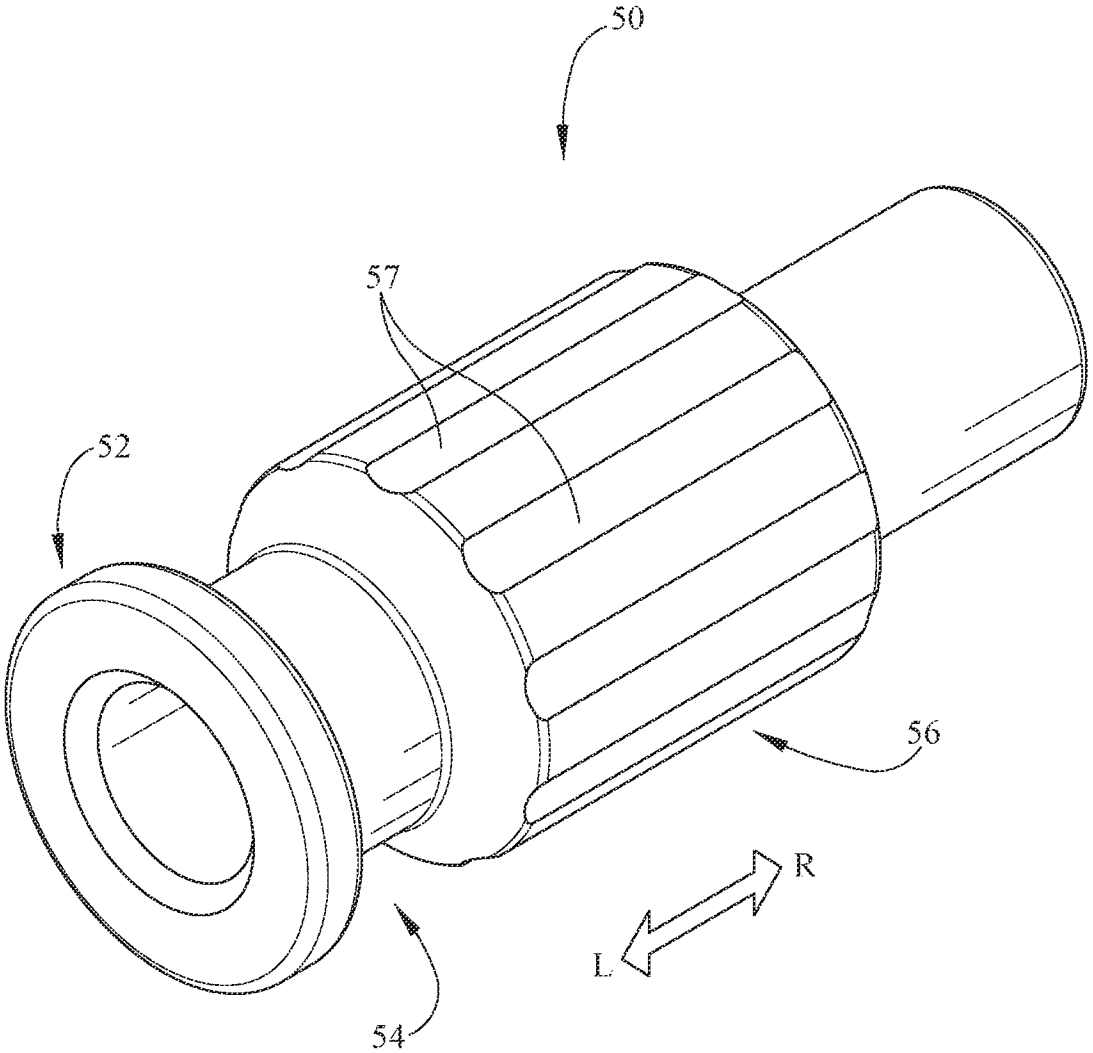
FIG. 7 is a perspective view of an interference piston.

With reference to FIG. 7, the interference piston 50 is shown in perspective view. The interference piston 50 may have various cross-sectional shapes but in the example may be circular. The interference piston 50 includes a lip 52 at one end of the piston 50, and a groove 54 between the lip 52 and an enlarged portion 56. The enlarged portion 56 may have a smooth outer surface or may have a number of features, such as flutes 57 to reduce bearing surface and friction within the housing 20, where the interference piston 50 is located.

With reference to FIGS. 6-7, as may be gleaned from the engagement of the safety selector shaft 40 and the lip 52, when the safety selector switch 30 (FIG. 5) is actuated forward, the cam 48 urges the lip 52, for example in the left-hand direction as depicted, which inhibits engagement of the interference piston 50 with a safety plunger. Once moved forward, the firearm is in the fire-ready position. Alternatively, when the safety selector switch 30 is moved rearward, the lip 52 engages the angled portion of the cam 48 allowing the interference to move to the right, in the depicted orientation, so that the interference piston 50 will engage the safety plunger, and inhibiting firing of the weapon. By varying the shape of the cam 48, the direction of movement and the amount of movement of the interference piston 50 may be varied.

Figure 8:
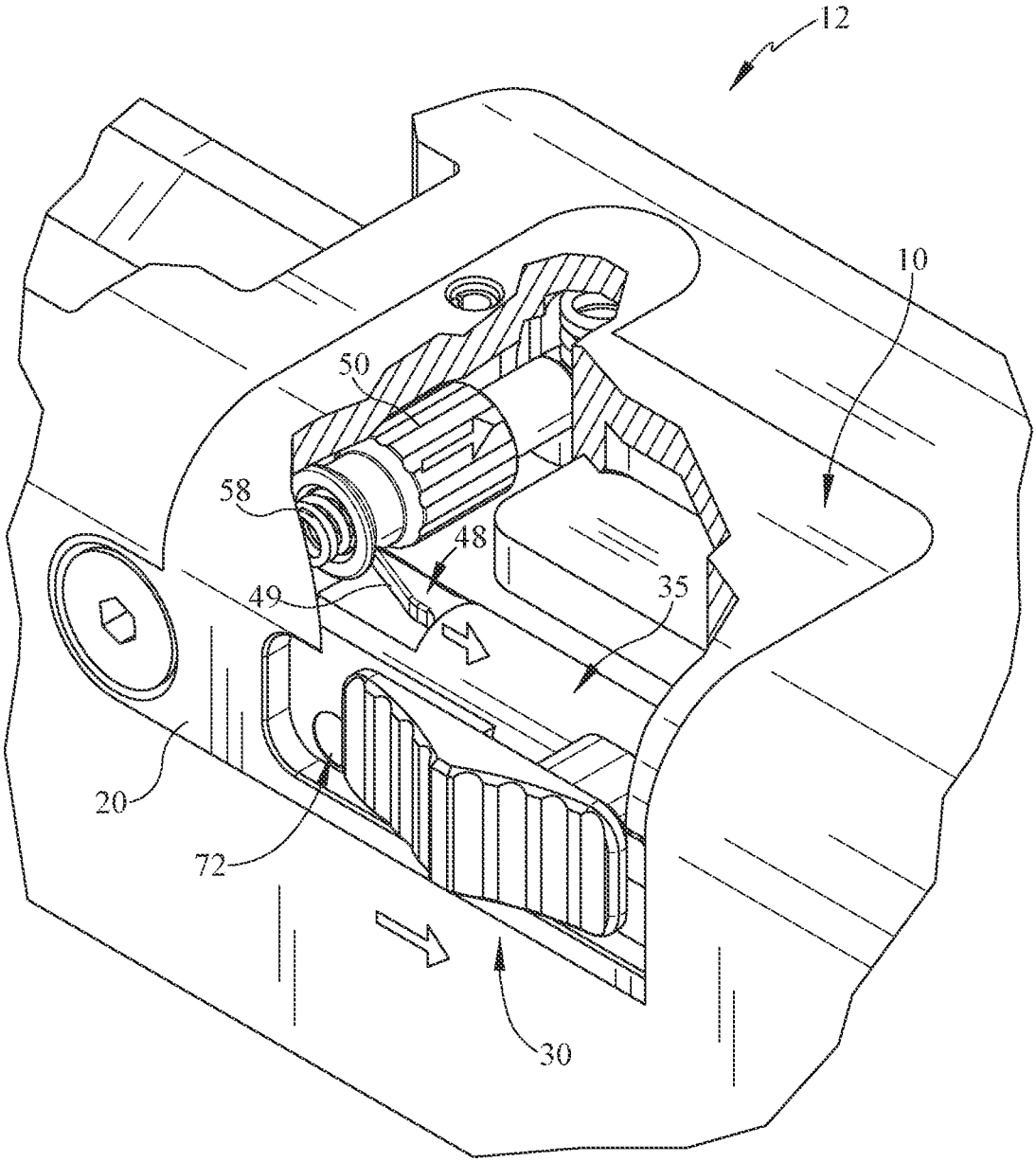
FIG. 8 is a first sequence view of the safety switch safety selector assembly moved to a safety, no-fire position and the resultant movement of the safety selector shaft and interference piston.

With reference now to FIG. 8, a first perspective sequence view is shown. The safety selector switch 30 is disposed rearwardly in a safe, no-fire position. With a portion of the housing 20 cut-away, and the switch 30 in a rearward position, the cam 48 is also shown in a rearward position. A biasing feature 58 is shown acting on the interference piston 50. In some embodiments, the biasing feature 58 may be a spring, but other biasing structures may be utilized. The force of the biasing feature 58 is normally acting to force the interference piston 50 into a blocking position according to one exemplary embodiment. Accordingly, the cam 48 forces movement of the interference piston 50 against the force of the biasing element 58.

In the instant step of the sequence, with the safety selector switch 30 rearward, the cam 48 is shaped so that the interference piston 50 is able to be moved by the biasing element 58.

As shown in the view of FIG. 8, the cam 48 shaped to allow for movement of the interference piston 50, to the right in the example orientation depicted. The cam 48 is angled relative to longitudinal direction of the safety selector shaft 35. The angled cam surface 49 can engage the lip 52, or follower, in order to force the movement of the interference piston 50 to the left and against the force of the biasing element 58.

Figure 9:
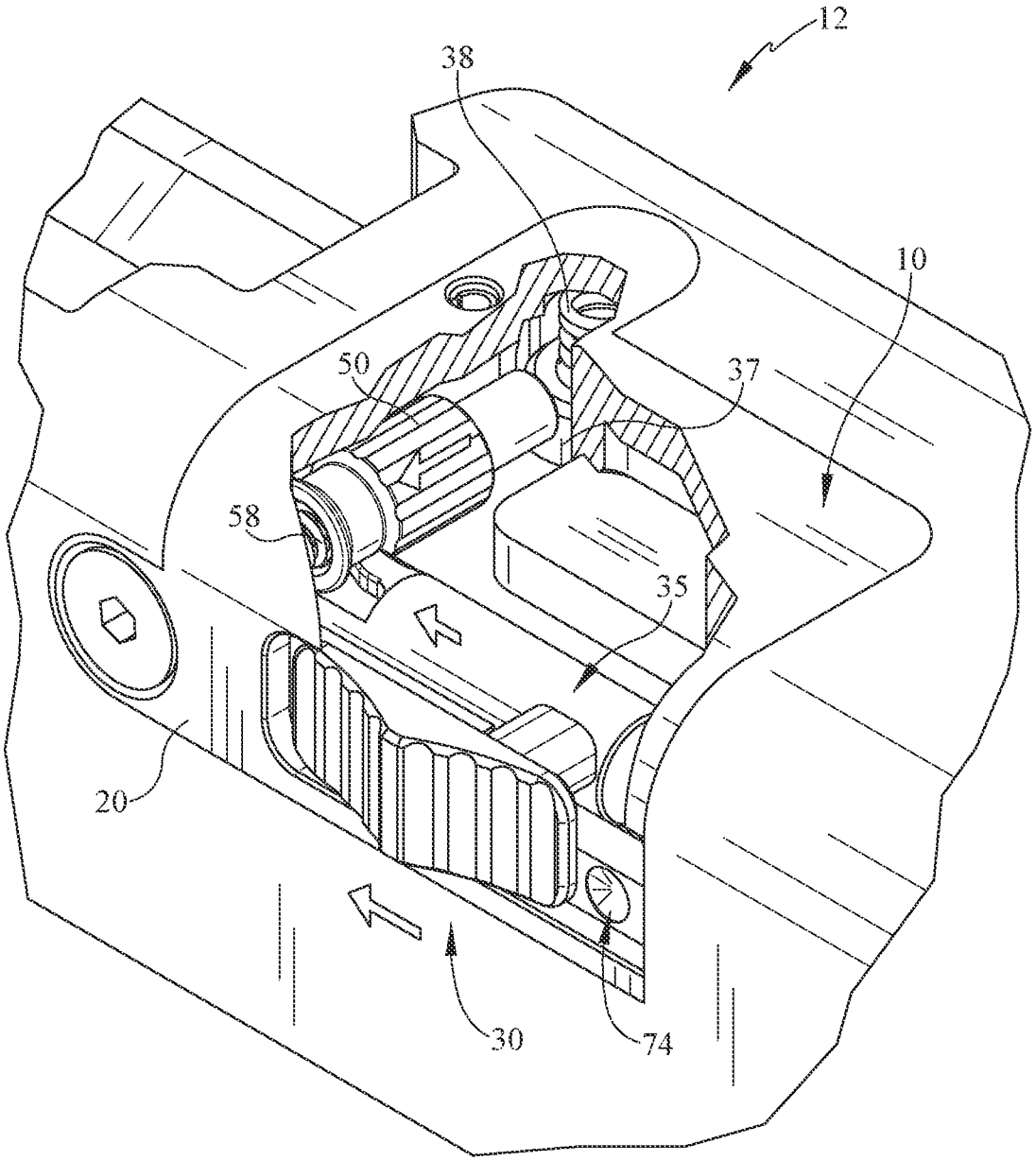
FIG. 9 is a second sequence view of a safety selector assembly in a fire ready position; and, FIG. 10 is a bottom perspective partial section view depicting a ball detent and safety selector shaft engagement for guided motion within the safety housing.
Figure 10:
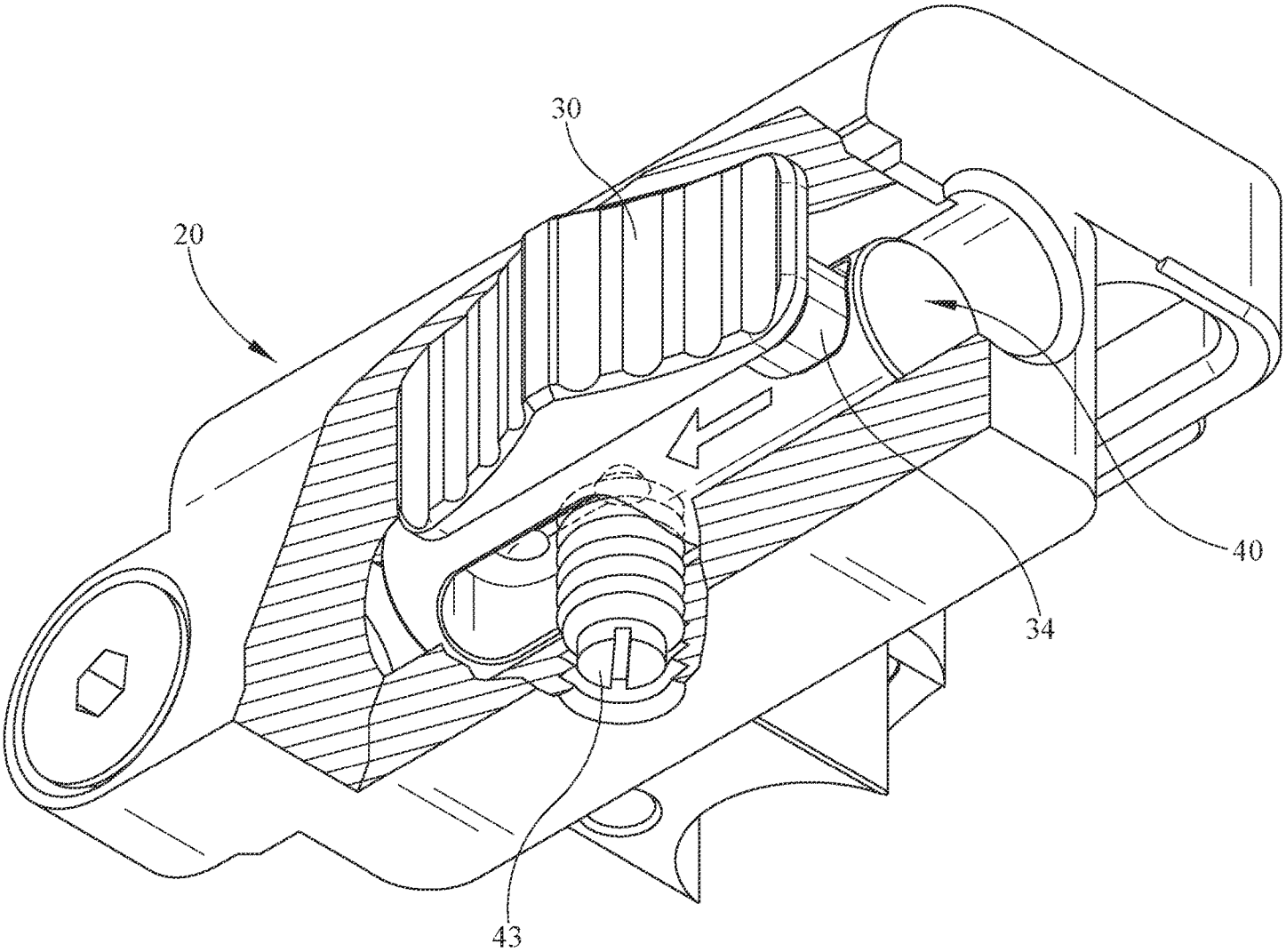

With reference now to FIG. 9, a next perspective sequence is shown. In this view, the safety selector switch 30 is pushed forward, to the ready-fire position. When the safety selector switch 30 moves forward, the safety selector shaft 35 also moves forward causing the angled cam surface 49 to urge the interference piston 50 to the left. As the piston 50 moves to the left, against the biasing element 58, the interference piston 50 no longer interferes with the spring 38. Thus, the firearm may be fired.

Still further, and in view of both FIGS. 8 and 9, the movement of the safety selector switch 30 reveals two indicators 72, 74. The indicators 72, 74 may indicate when the firearm is in a ready to fire or safety (non-fireable) condition. The indicators 72, 74 may be differing colors or may be have other distinguishable features, each of which represents a different firing condition.

As one skilled in the art will realize, different firearm slides have different firing mechanicals within. Accordingly, the shape and dimension of the parts may be varied in order operate within the environment of alternative slides.

Additionally, while the safety selector switch 30 is shown moving in a forward-rearward direction of the slide 12, the switch 30 may also be arranged to move in an upward-downward direction to place the weapon in a safe position.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the U.S. Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A safety selector assembly, comprising:

a safety housing;

a safety selector switch having an actuator and a stem, said safety selector switch linearly movable relative to said safety housing within a channel of said safety housing;

a safety selector shaft having a cam surface, said stem engaging said cam surface wherein movement of the stem causes movement of said safety selector shaft; and, an interference piston which moves linearly between a first position and a second interference position based on movement of said safety selector switch and said safety selector shaft, said interference piston urged by a biasing element to said second interference position which is a safe, no-fire position and wherein linear movement of said safety selector switch overcomes said biasing element by engagement of said cam surface and said interference piston.

2. The safety selector assembly of claim 1, said safety selector assembly being configured to connect to a firearm slide.

3. The safety selector assembly of claim 2, said safety selector switch is moveable in one of a longitudinal, a lateral, or a vertical direction of said firearm slide.

4. The safety selector assembly of claim 1, said interference piston having said first position wherein a safety plunger can move.

5. The safety selector assembly of claim 4, said interference piston having said second interference position wherein a safety plunger cannot move due to interference with said interference piston.

6. The safety selector assembly of claim 1, said safety housing having a fastener aperture which allows for connection to a firearm slide within a longitudinal surface of said firearm slide.

7. The safety selector assembly of claim 1, said safety housing further comprising a spring seat.

8. The safety selector assembly of claim 1, said safety housing comprising a bore having the safety selector shaft therein.

9. The safety selector assembly of claim 8, said safety housing comprising said channel in open communication with said bore.

10. The safety selector assembly of claim 1, said interference piston engaging said cam surface wherein movement of said safety selector shaft causes movement of said interference piston between said first position and said second interference position.

* * * * *